US012593864B2

(12) United States Patent
Sintyureva

(10) Patent No.: US 12,593,864 B2
(45) Date of Patent: Apr. 7, 2026

(54) METHOD OF MAKING A TOBACCO EXTRACT

(71) Applicant: NICOVENTURES TRADING LIMITED, London (GB)

(72) Inventor: Marina Sintyureva, London (GB)

(73) Assignee: NICOVENTURES TRADING LIMITED, London (GB)

( * ) Notice: Subject to any disclaimer, the term of this patent is extended or adjusted under 35 U.S.C. 154(b) by 153 days.

(21) Appl. No.: 16/614,111

(22) PCT Filed: May 9, 2018

(86) PCT No.: PCT/EP2018/062117
§ 371 (c)(1),
(2) Date: Nov. 15, 2019

(87) PCT Pub. No.: WO2018/210676
PCT Pub. Date: Nov. 22, 2018

(65) Prior Publication Data

US 2021/0153542 A1 May 27, 2021

(30) Foreign Application Priority Data

May 15, 2017 (GB) ..... 1707759

(51) Int. Cl.
*A24B 15/167* (2020.01)
*A24B 15/24* (2006.01)
*A24B 15/26* (2006.01)
*A24B 15/30* (2006.01)

(52) U.S. Cl.
CPC ..... *A24B 15/167* (2016.11); *A24B 15/243* (2013.01); *A24B 15/26* (2013.01); *A24B 15/301* (2013.01)

(58) Field of Classification Search
CPC ..... A24B 15/24; A24B 15/243; A24B 15/26; A24F 40/10; A24F 40/50; A24F 40/60; A24F 40/90
See application file for complete search history.

(56) References Cited

U.S. PATENT DOCUMENTS

| | | | | |
|---|---|---|---|---|
| RE12,994 | E | 7/1909 | Gloystbin | |
| 3,880,172 | A | 4/1975 | Anderson et al. | |
| 4,153,063 | A * | 5/1979 | Roselius | A24B 15/24 131/297 |
| 4,506,682 | A | 3/1985 | Muller | |
| 4,561,452 | A | 12/1985 | Gahrs | |
| 4,727,889 | A * | 3/1988 | Niven, Jr. | A24B 15/26 131/297 |
| 4,734,484 | A | 3/1988 | Alfes et al. | |
| 4,756,318 | A | 7/1988 | Clearman et al. | |
| 5,018,540 | A | 5/1991 | Grubbs et al. | |
| 5,025,812 | A | 6/1991 | Fagg et al. | |
| 5,065,775 | A | 11/1991 | Fagg | |
| 5,073,267 | A | 12/1991 | Adda | |
| 5,119,835 | A | 6/1992 | Heemann et al. | |
| 5,318,050 | A | 6/1994 | Gonzalez-Parra et al. | |
| 5,435,325 | A | 7/1995 | Clapp et al. | |
| 5,497,792 | A | 3/1996 | Prasad et al. | |
| 5,617,881 | A | 4/1997 | Kossmehl et al. | |
| 7,726,320 | B2 | 6/2010 | Robinson et al. | |
| 8,479,747 | B2 | 7/2013 | O'Connell | |
| 8,887,737 | B2 | 11/2014 | Howell et al. | |
| 9,554,595 | B2 | 1/2017 | Buchberger | |
| 10,123,560 | B2 | 11/2018 | Rasouli et al. | |
| 10,271,573 | B2 | 4/2019 | Lipowicz | |
| 10,375,996 | B2 | 8/2019 | Aoun et al. | |
| 10,390,555 | B2 | 8/2019 | Fujisawa et al. | |
| 10,426,199 | B2 | 10/2019 | Turner et al. | |
| 11,044,938 | B2 | 6/2021 | Buehler et al. | |
| 11,330,834 | B2 | 5/2022 | Osuga et al. | |

(Continued)

FOREIGN PATENT DOCUMENTS

| | | |
|---|---|---|
| CN | 1440699 A | 9/2003 |
| CN | 1459256 A | 12/2003 |

(Continued)

OTHER PUBLICATIONS

International Search Report and Written Opinion, Application No. PCT/EP2018/062117, mailed Jul. 31, 2018, 14 pages.
Anonymous: iFUSE—the Heat not Burn hybrid—Heat Not Burn, Jan. 4, 2017 (Jan. 4, 2017), XP055493889. Retrieved from the Internet: URL:https://heatnotburn.co.uk/ifuse-heat-not-burn-hybrid/ [retrieved on Jul. 19, 2018], p. 1-p. 15.
Anonymous: Where does the nicotine used in electronic cigarettes come from? Quora—Aug. 23, 2015 (Aug. 23, 2015), XP055494026, Retrieved from the Internet: URL: https://www.quora.com/Where-does-the-nicotine-used -in-electronic-cigarettes- come-from [retrieved on Jul. 19, 2018], 2 pages.

(Continued)

*Primary Examiner* — Michael H. Wilson
*Assistant Examiner* — Stephanie Lynn Moore
(74) *Attorney, Agent, or Firm* — WOMBLE BOND DICKINSON (US) LLP

(57) ABSTRACT

Embodiments described herein provide a method of making a tobacco extract comprising; (a) contacting tobacco with an extraction solvent in a first chamber such that tobacco components are extracted from the tobacco into the extraction solvent, wherein the extraction solvent is a supercritical fluid in the first chamber; (b) passing the extraction solvent containing tobacco components along a line towards a second chamber, wherein a valve is present in the line and the conditions downstream of the valve are such that the extraction solvent is subcritical; and (c) pumping entrapment solvent into a flow downstream of the valve, wherein the tobacco components are released from the extraction solvent by transfer to subcritical conditions and are dissolved in the entrapment solvent, whereby the tobacco components dissolved in entrapment solvent are collected in the second chamber.

13 Claims, No Drawings

(56) References Cited

U.S. PATENT DOCUMENTS

| | | | | |
|---|---|---|---|---|
| 11,511,056 | B2 | 11/2022 | Hepworth et al. | |
| 11,612,702 | B2 | 3/2023 | Bowen et al. | |
| 11,672,276 | B2 | 6/2023 | Yilmaz et al. | |
| 2004/0025891 | A1 | 2/2004 | McAdam et al. | |
| 2006/0196517 | A1 | 9/2006 | Gedevanishvili et al. | |
| 2007/0023058 | A1* | 2/2007 | Howell | A24B 15/243 131/297 |
| 2007/0137663 | A1 | 6/2007 | Taylor et al. | |
| 2007/0193595 | A1 | 8/2007 | Haruki et al. | |
| 2008/0257367 | A1 | 10/2008 | Paterno et al. | |
| 2009/0032036 | A1 | 2/2009 | Uematsu et al. | |
| 2011/0159160 | A1 | 6/2011 | Jonsson et al. | |
| 2011/0259353 | A1 | 10/2011 | Coleman, III et al. | |
| 2012/0006341 | A1 | 1/2012 | Schmekel et al. | |
| 2012/0125354 | A1 | 5/2012 | Byrd et al. | |
| 2012/0145170 | A1 | 6/2012 | O'Connell | |
| 2012/0152265 | A1 | 6/2012 | Dube et al. | |
| 2012/0167901 | A1 | 7/2012 | Onno | |
| 2012/0199145 | A1 | 8/2012 | Byrd et al. | |
| 2012/0318287 | A1 | 12/2012 | Andersen | |
| 2013/0008457 | A1 | 1/2013 | Zheng et al. | |
| 2013/0160777 | A1 | 6/2013 | Murphy | |
| 2013/0239981 | A1 | 9/2013 | Sun et al. | |
| 2013/0255702 | A1* | 10/2013 | Griffith, Jr. | A24F 40/70 131/328 |
| 2014/0096780 | A1 | 4/2014 | Gerardi | |
| 2014/0190500 | A1 | 7/2014 | Duan et al. | |
| 2014/0238396 | A1 | 8/2014 | Buchberger | |
| 2014/0261483 | A1 | 9/2014 | Hopps | |
| 2015/0027453 | A1 | 1/2015 | Tessmann | |
| 2015/0150305 | A1 | 6/2015 | Shenkal | |
| 2015/0374035 | A1 | 12/2015 | Sanchez et al. | |
| 2016/0081395 | A1 | 3/2016 | Thorens et al. | |
| 2016/0100626 | A1 | 4/2016 | Ishida | |
| 2016/0106144 | A1 | 4/2016 | Muehlbauer et al. | |
| 2016/0205992 | A1 | 7/2016 | Bell et al. | |
| 2018/0020735 | A1* | 1/2018 | Bilat | H05B 1/0277 |
| 2019/0320718 | A1 | 10/2019 | Yilmaz et al. | |
| 2021/0106051 | A1 | 4/2021 | Han et al. | |

FOREIGN PATENT DOCUMENTS

| | | | | |
|---|---|---|---|---|
| CN | 1899142 | A | 1/2007 | |
| CN | 101247739 | A | 8/2008 | |
| CN | 101338248 | A | 1/2009 | |
| CN | 101830941 | A | 9/2010 | |
| CN | 102106602 | A | 6/2011 | |
| CN | 102199490 | A | 9/2011 | |
| CN | 102326859 | A | 1/2012 | |
| CN | 102488318 | A | 6/2012 | |
| CN | 102640985 | A | 8/2012 | |
| CN | 102894469 | A | 1/2013 | |
| CN | 102994228 | A | 3/2013 | |
| CN | 103060094 | A | 4/2013 | |
| CN | 103230094 | A | 8/2013 | |
| CN | 103235066 | A | 8/2013 | |
| CN | 103242960 | A | 8/2013 | |
| CN | 103462206 | A | 12/2013 | |
| CN | 103468403 | A | 12/2013 | |
| CN | 103484245 | A | 1/2014 | |
| CN | 103720030 | A | 4/2014 | |
| CN | 103783651 | A | 5/2014 | |
| CN | 103783660 | A | 5/2014 | |
| CN | 103881817 | A | 6/2014 | |
| CN | 104489912 | A | 4/2015 | |
| CN | 105641970 | A | 6/2016 | |
| DE | 554139 | C | 7/1932 | |
| EP | 0280817 | A2 | 9/1988 | |
| EP | 0323699 | A2 * | 11/1988 | A24B 15/26 |
| EP | 0338831 | A2 | 10/1989 | |
| EP | 0434333 | A2 | 6/1991 | |
| EP | 0443761 | A1 | 8/1991 | |
| EP | 0822247 | A2 | 2/1998 | |
| EP | 0941140 | B1 | 11/2002 | |
| EP | 0845220 | B1 | 9/2003 | |
| EP | 1355708 | A2 | 10/2003 | |
| EP | 1267650 | B1 | 12/2005 | |
| EP | 1815899 | A1 | 8/2007 | |
| EP | 1915064 | A2 | 4/2008 | |
| EP | 1980163 | A1 | 10/2008 | |
| EP | 2303425 | A1 | 4/2011 | |
| EP | 2544560 | A1 | 1/2013 | |
| EP | 2560509 | A1 | 2/2013 | |
| EP | 2008534 | B1 | 7/2013 | |
| EP | 2640204 | A1 | 9/2013 | |
| EP | 2523568 | B1 | 12/2013 | |
| EP | 2727477 | A2 | 5/2014 | |
| EP | 1951074 | B1 | 7/2014 | |
| EP | 2769631 | A1 | 8/2014 | |
| EP | 1915064 | B1 | 4/2017 | |
| GB | 1357645 | A | 6/1974 | |
| GB | 2173985 | A | 10/1986 | |
| GB | 2515883 | A | 1/2015 | |
| JP | S519838 | A | 1/1976 | |
| JP | S62176504 | A | 8/1987 | |
| JP | S63229102 | A | 9/1988 | |
| JP | H0249572 | A | 2/1990 | |
| JP | H03127975 | A | 5/1991 | |
| JP | H069986 | A | 1/1994 | |
| JP | H0698746 | A | 4/1994 | |
| JP | H07227502 | A | 8/1995 | |
| JP | H0819389 | A | 1/1996 | |
| JP | H0823952 | A | 1/1996 | |
| JP | H0910502 | A | 1/1997 | |
| JP | 3014704 | B2 | 2/2000 | |
| JP | 3223058 | B2 | 10/2001 | |
| JP | 2001276603 | A | 10/2001 | |
| JP | 3325028 | B2 | 9/2002 | |
| JP | 2005532821 | A | 11/2005 | |
| JP | 2007136404 | A | 6/2007 | |
| JP | 2008055255 | A | 3/2008 | |
| JP | 2009502160 | A | 1/2009 | |
| JP | 2014530633 | A | 11/2014 | |
| JP | 2017511703 | A | 4/2017 | |
| KR | 20170040787 | A | 4/2017 | |
| KR | 20170046938 | A | 5/2017 | |
| RU | 2250717 | C2 | 4/2005 | |
| RU | 2250718 | C2 | 4/2005 | |
| RU | 2250724 | C2 | 4/2005 | |
| RU | 2250734 | C2 | 4/2005 | |
| RU | 2250739 | C2 | 4/2005 | |
| WO | WO-9808584 | A1 | 3/1998 | |
| WO | WO-0165954 | A1 | 9/2001 | |
| WO | WO-0226343 | A2 | 4/2002 | |
| WO | WO-2004008888 | A1 | 1/2004 | |
| WO | WO 2007/052159 | | 5/2007 | |
| WO | WO-2007053096 | A1 | 5/2007 | |
| WO | WO-2007053097 | A1 | 5/2007 | |
| WO | WO-2007053098 | A1 | 5/2007 | |
| WO | WO-2008026446 | A1 | 3/2008 | |
| WO | WO-2009019514 | A2 | 2/2009 | |
| WO | WO-2009156763 | A1 | 12/2009 | |
| WO | WO-2011088171 | A2 | 7/2011 | |
| WO | 2011110843 | A1 | 9/2011 | |
| WO | WO-2011133633 | A1 | 10/2011 | |
| WO | 2012068375 | A1 | 5/2012 | |
| WO | WO-2012174677 | A1 | 12/2012 | |
| WO | WO-2013060827 | A1 | 5/2013 | |
| WO | WO-2013142483 | A1 | 9/2013 | |
| WO | WO-2013187402 | A1 | 12/2013 | |
| WO | WO-2014058837 | A1 | 4/2014 | |
| WO | WO-2014094337 | A1 | 6/2014 | |
| WO | WO 2015107552 | | 7/2015 | |
| WO | WO-2015177177 | A1 | 11/2015 | |
| WO | WO-2016005709 | A1 | 1/2016 | |
| WO | WO-2016024083 | A1 | 2/2016 | |
| WO | WO-2016062777 | A1 | 4/2016 | |
| WO | 2016135331 | A1 | 9/2016 | |
| WO | WO-2016184977 | A1 | 11/2016 | |
| WO | 2018210675 | A1 | 11/2018 | |
| WO | 2018210676 | A1 | 11/2018 | |
| WO | 2018210677 | A1 | 11/2018 | |
| WO | 2018210678 | A1 | 11/2018 | |

(56) References Cited

FOREIGN PATENT DOCUMENTS

| | | | |
|---|---|---|---|
| WO | 2018210679 | A1 | 11/2018 |
| WO | 2018210680 | A1 | 11/2018 |
| WO | 2018210681 | A2 | 11/2018 |

OTHER PUBLICATIONS

International Preliminary Report on Patentability for Application No. PCT/EP2018/062119, mailed on Nov. 28, 2019, 8 pages.
International Preliminary Report on Patentability for Application No. PCT/EP2018/062120, mailed on Nov. 28, 2019, 9 pages.
International Preliminary Report on Patentability for Application No. PCT/EP2018/062122, mailed on Nov. 28, 2019, 9 pages.
International Preliminary Report on Patentability for Application No. PCT/EP2018/062116, mailed on Nov. 28, 2019, 8 pages.
International Preliminary Report on Patentability for Application No. PCT/EP2018/062121, mailed on Nov. 28, 2019, 8 pages.
International Preliminary Report on Patentability for Application No. PCT/EP2018/062123, mailed on Nov. 28, 2019, 10 pages.
International Preliminary Report on Patentability for Application No. PCT/EP2018/062117, mailed on Nov. 28, 2019, 8 pages.
International Search Report and Written Opinion for Application No. PCT/EP2018/062116, mailed on Aug. 20, 2018, 22 pages.
International Search Report and Written Opinion for Application No. PCT/EP2018/062119, mailed on Jul. 30, 2018, 10 pages.
International Search Report and Written Opinion for Application No. PCT/EP2018/062120, mailed on Jul. 30, 2018, 15 pages.
International Search Report and Written Opinion for Application No. PCT/EP2018/062121, mailed on Jul. 30, 2018, 14 pages.
International Search Report and Written Opinion for Application No. PCT/EP2018/062122, mailed on Jul. 31, 2018, 15 pages.
International Search Report and Written Opinion for Application No. PCT/EP2018/062123, mailed on Nov. 28, 2018, 19 pages.
Marcolli C et al., "Water activity in polyol/Water Systems: New UNIFAC Parameterization," Atmospheric Chemistry and Physics, Copernicus GMBH, Germany, vol. 5, No. 6, Jun. 1, 2005, pp. 1545-1555, Retrieved from the Internet: URL: http://www.atmos-chemphys.net/5/1545/2005/acp-5-1545-2005.pdf [retrieved on Nov. 26, 2014].
Notice of Reasons for Refusal for Japanese Application No. 2019-562269, mailed on Mar. 2, 2021, 12 pages.
Office Action for Japanese Application No. 2019-562270, mailed on Dec. 8, 2020, 6 pages.
Office Action For Japanese Application No. 2019-562304, mailed on Dec. 1, 2020, 6 pages.
Office Action for Japanese Application No. 2019-562384, mailed on Dec. 1, 2020, 5 pages.
Office Action for Japanese Application No. 2019-562289, mailed on Dec. 8, 2020, 6 pages.
Office Action for Korean Application No. 10-2019-7033531, mailed on Aug. 24, 2021, 12 pages.
Office Action for Korean Application No. 10-2019-7033532 mailed on Feb. 7, 2021, 9 pages.
Office Action For Korean Application No. 10-2019-7033534, mailed on Aug. 24, 2021, 13 pages.
Office Action For Korean Application No. 10-2019-7033535, mailed on Aug. 24, 2021, 12 pages.
Office Action For Korean Application No. 10-2019-7033533, mailed on Aug. 24, 2021, 12 pages.
Office Action mailed Feb. 2, 2021 for Japanese Application No. 2019-562273, 12 pages.
Office Action mailed Apr. 24, 2020 for Russian Application No. 2019136484, 18 pages.
Search Report for Japanese Application No. 2019-562269, mailed Feb. 17, 2021, 20 pages.
Application and File History for U.S. Appl. No. 16/614,119, filed Nov. 15, 2019, Inventor Helena Digard.
Application and File History for U.S. Appl. No. 16/614,267, filed Nov. 15, 2019, Inventor Helena Digard et al.
Application and File History for U.S. Appl. No. 16/614,269, filed Nov. 15, 2019, Inventor Helena Digard et al.
Application and File History for U.S. Appl. No. 16/614,270, filed Nov. 15, 2019, Inventor Geoff Foss-Smith et al.
Application and File History for U.S. Appl. No. 16/614,274, filed Nov. 15, 2019, Inventor Marina Sintyureva.
Application and File History for U.S. Appl. No. 16/614,276, filed Nov. 15, 2019, Inventor Marina Sintyureva et al.
Merriam-Webster, "Definition of Through," Retrieved from https://www.merriam-webster.com/dictionary/through, 2022, 9 pages.
Office Action for Canadian Application No. 3,062,987, mailed on Oct. 7, 2022, 4 pages.
Application and File History for U.S. Appl. No. 16/614,111, filed Nov. 15, 2019, Inventor Marina Sintyureva.
"Boiling Points and Structures of Hydrocarbons", 2003, [online], Virtual Chembook, Elmhurst College, Retrieved from, http://chemistry.elmhurst.edu/vchembook/501hcboilingpts.html, on Apr. 27, 2022, 1 page.
Munters., "Sieve Trays," 2022, Retrieved from the Internet: https://www.munters.com/en/munters/products/mass-transfer/sieve-trays/, 4 pages.
"Tray Column &Tray Types," Plant operations: Trays Types, 2016, Retrieved from the Internet: http://www.separationprocesses.com/Operations/POT_Chp02a.htm, 2 pages.
"Search Report received for Chinese Patent Application No. 201880032692.4, mailed on Jun. 25, 2021", 1 page (English Translation Only).

* cited by examiner

METHOD OF MAKING A TOBACCO EXTRACT

PRIORITY CLAIM

The present application is a National Phase entry of PCT Application No. PCT/EP2018/062117, filed May 9, 2018, which claims priority from GB Patent Application No. 1707759.5, filed May 15, 2017, which is hereby fully incorporated herein by reference.

TECHNICAL FIELD

The present invention relates to a method of making a tobacco extract and to the tobacco extract resulting from that process. The invention also provides cartridges containing the tobacco extract for use in a smoking article, and smoking articles comprising the tobacco extract.

BACKGROUND

Tobacco material is heated in smoking articles for the purpose of releasing substances contained in the material and delivering these as an aerosol.

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, material. The material may be, for example, tobacco or other non-tobacco products, which may or may not contain nicotine.

Electronic cigarettes or "e-cigarettes" are another product that has been formulated as an alternative to combustible products. These devices contain a volatilizable solution which generates an inhalable aerosol on heating. These solutions may contain components of tobacco. It is therefore useful to be able to selectively extract tobacco components.

EP1915064 describes a process for making reconstituted tobacco including a tobacco extraction step. The extraction process uses supercritical carbon dioxide to extract the tobacco components, and then contacts the supercritical carbon dioxide containing tobacco components with propylene glycol. The tobacco components transfer into the propylene glycol. The carbon dioxide is supercritical throughout.

SUMMARY

According to a first aspect of the present invention, there is provided a method of making a tobacco extract comprising;

(a) contacting tobacco with an extraction solvent in a first chamber such that tobacco components are extracted from the tobacco into the extraction solvent, wherein the extraction solvent is a supercritical fluid in the first chamber;

(b) passing the extraction solvent containing tobacco components along a line towards a second chamber, wherein a valve is present in the line and the conditions downstream of the valve are such that the extraction solvent is subcritical; and (c) pumping entrapment solvent into a flow downstream of the valve, wherein the tobacco components are released from the extraction solvent by transfer to subcritical conditions and are dissolved in the entrapment solvent, whereby the tobacco components dissolved in entrapment solvent are collected in the second chamber.

In some cases, the entrapment solvent is pumped into the flow upstream of the second chamber. In other words, the entrapment solvent is pumped into the line between the first and second chambers.

The inventors have established that variations in the extraction process using a supercritical extraction solvent result in variation in the tobacco extract composition and/or in the physical properties of the extract.

The transfer to subcritical conditions allows for efficient and effective separation of the tobacco components and extraction solvent. This means that the concentration of tobacco components in the entrapment solvent is higher and the chemical make-up is different as compared to the process of EP1915064 (in which the extraction solvent is supercritical throughout). This improves the organoleptic properties of the extract. Moreover, the extract resulting from the EP1915064 process has a lower viscosity than that resulting from the process according to the present invention; this is because the carbon dioxide extraction solvent of EP1915064 contacts the propylene glycol entrapment solvent, and gaseous carbon dioxide becomes entrained in the propylene glycol. A higher viscosity extract is better for use in smoking articles because the extract is easier to handle and easier to contain/retain in the article.

The use of subcritical conditions for separation is also advantageous over a process in which the conditions are such that the extraction solvent is supercritical throughout because less energy is required to maintain the conditions. The process is therefore more energy efficient, cheaper to run and is quicker to set up.

The inventors believe that pumping the entrapment solvent into the flow results in better homogeneity of the final extract (in the entrapment solvent) and more effective absorption of the flavor compounds into the entrapment solvent, as compared to the EP1915064 process in which the entrapment solvent is static in the second chamber throughout.

In some cases, the entrapment solvent comprises one or more aerosol generating agents. In some cases, the entrapment solvent consists essentially or of consists of one or more aerosol generating agents.

In some cases, the extraction solvent used in the above process comprises carbon dioxide. In some cases, the extraction solvent consists essentially of or consists of carbon dioxide.

In some cases, the entrapment solvent used in the above method comprises a polyol. In some cases, the entrapment solvent comprises glycerol and/or propylene glycol. In some cases, the entrapment solvent consists essentially of or consists of glycerol.

In some cases, the tobacco components extracted by the methods described herein include one or more of nicotine and tobacco aromas and flavors.

In some cases, the method described herein may further comprise the step of providing the entrapment solvent containing dissolved tobacco components in a cartridge, wherein the cartridge is configured for use in a smoking article.

According to a second aspect of the invention, there is provided a tobacco extract obtained by or obtainable by a method described herein.

According to a further aspect, there is provided a cartridge configured for use in a smoking article, the cartridge containing a tobacco extract obtained by or obtainable by a method described herein. The cartridge may be configured for use in an electronic cigarette.

According to a further aspect, there is provided a smoking article containing a tobacco extract obtained by or obtainable by a method described herein. In some cases, the smoking article may contain the tobacco extract in an insertable cartridge, the cartridge being configured for use in the smoking article. The smoking article may additionally comprise a mouthpiece. The smoking article may additionally comprise a heater which volatilizes the entrapment solvent containing tobacco extract in use.

The smoking article may be an electronic cigarette.

According to a further aspect, there is provided the use of a tobacco extract obtained by or obtainable by a method described herein to generate an inhalable aerosol. In some cases, the tobacco extract is used in a smoking article to generate the inhalable aerosol.

Further features and advantages of the invention will become apparent from the following description of preferred embodiments of the invention, given by way of example only.

DETAILED DESCRIPTION

For the avoidance of doubt, the term "tobacco extract" as used herein refers to the entrapment solvent containing tobacco components. A supercritical fluid is any substance at a temperature and pressure above its critical point, where distinct liquid and gas phases do not exist. Supercritical fluids can effuse through solids like a gas, and dissolve materials like a liquid. Supercritical fluids have a higher fluid density than gases and therefore have a higher solvent capacity.

In some cases, one or more flavors may be added to the tobacco extract. As used herein, the term "flavor" refers to materials which, where local regulations permit, may be used to create a desired taste or aroma in a product for adult consumers.

They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

As used herein, an "aerosol generating agent" is an agent that promotes the generation of an aerosol on heating. An aerosol generating agent may promote the generation of an aerosol by promoting an initial vaporization and/or the condensation of a gas to an inhalable solid and/or liquid aerosol.

In general, suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. In some cases, the aerosol generating agent comprises one or more of glycerol, propylene glycol, triacetin and isopropyl myristate, suitably glycerol and/or propylene glycol.

The weight ratio of aerosol generating agent to tobacco (dry weight) may be from about 2:1 to about 1:3, suitably from 3:2 to about 1:2, suitably about 1:1.

The method according to the invention may additionally comprise an initial step of adding water to the tobacco. The amount of water added may be from about 2% to about 20% based on the dry weight of tobacco, suitably from about 2%, 5% or 8% to about 12%, 15%, 18% or 20%. This pretreatment with water increases the transfer of polar tobacco components (such as flavors) from the tobacco to the entrapment solvent.

In the process according to the invention, a higher pressure under supercritical conditions increases the solvent capacity and increases the efficiency of extraction. However, more energy is required to achieve and maintain higher pressures. Thus, the supercritical conditions are suitably selected to balance these conflicting requirements. Where the supercritical fluid comprises carbon dioxide, the pressure at which extraction occurs may, in some cases, be from about 8 MPa, 10 MPa, 15 MPa, 20 MPa or 25 MPa to about 85 MPa, 70 MPa, 55 MPa, 40 MPa or 30 MPa, suitably from 8-85 MPa, 15-40 MPa or 20-30 MPa. Where the supercritical fluid comprises carbon dioxide, the temperature at which extraction occurs may, in some cases, be from about 308K, 318K or 328K to about 473K, 430K, 390K or 350K, suitably from 308-473K, 308-430K, or 328-350K.

The transfer to subcritical conditions reduces the fluid density of the extraction solvent and consequently results in precipitation of the tobacco components. The conditions must be such that the pressure is below the critical pressure of the extraction solvent and/or the temperature is below the critical temperature of the extraction solvent. For thermal efficiency, the conditions are suitably such that the pressure is below the critical pressure of the extraction solvent while the temperature remains above the critical temperature.

The efficiency of separation of the tobacco components and the extraction solvent improves as the conditions move further below the critical point of the extraction solvent. However, the extraction solvent will typically be collected and stored after separation (requiring compression); in some cases, it may be recycled into an extraction chamber. Thus, the subcritical conditions are suitably not too far below the critical point to improve energy efficiency. The subcritical conditions are suitably selected to balance these conflicting requirements. Where the extraction solvent comprises carbon dioxide, the pressure at which separation occurs may, in some cases, be from about 3 MPa, 4 MPa, 5 MPa or 5.5 MPa to about 7.3 MPa, 7 MPa, 6.5 MPa, 6 MPa, 5.5 MPa or 5 MPa, suitably from 3-7.3 MPa, or 4-6 MPa. Where the extraction solvent comprises carbon dioxide, the temperature of the subcritical conditions under which separation occurs may, in some cases, be from about 280K, 300K, 320K or 330K to about 473K, 430K, 390K or 350K, suitably from 308-473K, 308-430K, or 328-350K.

The rate at which the entrapment solvent is pumped into the flow may be selected such that the flow of entrapment solvent into the system is approximately constant throughout the process.

EXAMPLES

Analytical Methods

Water activity values reported below were measured at 24.9-25.2° C. using the Aqualab Prewater Activity meter. The values were determined using the dewpoint method.

Viscosity values reported below were measured at 25° C. using a Gemini Rheometer from Bohlin Instruments.

Pre-Extraction (Pre-Treatment of Tobacco):

Ground Virginia tobacco leaf of the particle size ranging from 355 μm to 3.5 mm was pre-treated by addition of water (10% of total tobacco weight). The mixture of tobacco and water was left for equilibration for 15 minutes post water addition (which is sufficient time for the water to be fully absorbed).

The pre-treated tobacco (1.2 kg plus 10 wt % water) was placed in a stainless steel extraction basket and the basket placed in an extraction vessel (5 L autoclave). The basket was closed at its ends by sinter metal plates (pore diameter 100 μm, pressure drop across the plate is no more than 1 bar), which distributed the supercritical fluid at the entrance and prevented egress of solid particles at the exit. The use of the basket also allowed the fast charge and discharge of the extraction vessel. The basket was sealed against the extraction vessel wall in order to prevent flow of the supercritical fluid around it.

Example 1: Example of Process According to the Invention

The extraction vessel was linked to a separation vessel by a transfer line. A pressure regulation valve was present in the line. Carbon dioxide may suitably be pumped through the system at the rate 5-23 kg/hr. In this case, carbon dioxide was pumped through the system at the rate of 10 kg/hr.

The extraction chamber was maintained at 26 MPa and 338K and the separation chamber was maintained at 4.5 MPa and 318K. Precipitation of the extract in the separation chamber was achieved by pressure and temperature reduction (from supercritical to subcritical conditions) at the regulation valve, which reduced the fluid density of the carbon dioxide and therefore the solvent-power of the CO2. Glycerol, pre-heated to 318K was pumped into the line between the regulation valve and the separation vessel at 6.7 g/min (so that 1.2 kg of glycerol was injected into the line over the course of the experiment). The glycerol containing extracted tobacco components was collected at the bottom of the separator.

Gaseous CO2 exited the separator after passing through a liquid/gas divider (which removed any remaining liquid extract that is entrained in the gas). The CO2 was collected and recycled into the extraction chamber.

The process was run for three hours and then the CO2 flow was shut-off. The system was depressurized (to atmospheric conditions). The glycerol containing tobacco components was then drained from the separator vessel and weighed.

Comparative Test

A comparative test was run using the same apparatus as in example 1. However, the conditions were supercritical (26 MPa and 338K) throughout the apparatus. Further, rather than injecting glycerol into the line between the extraction and separation chambers, glycerol was simply provided in the separation chamber before the extraction was initiated and was present in the separation chamber throughout the process.

All other aspects of the comparative test were the same as in example 1.

The comparative test is a representative example of the processes described generally in EP1915064.

Data

Tobacco Extract Properties:

| Experiment | Nicotine (mg/g) | Water (wt %) | NNN (ng/g) | NNK (ng/g) | Viscosity (Pa s) | pH | Density (g/cm$^3$) | Water activity (Aw) |
|---|---|---|---|---|---|---|---|---|
| Example 1 | 10.45 | 9.1 | 111 | 72 | 0.74 | 5.38 | 1.26 | 0.14 |
| Comp. Test | 4.7 | 5.5 | 1.1 | 9.1 | 0.32 | 6.73 | 1.25 | 0.24 |

It can be seen that injecting glycerol into the line between the extraction and separation chambers alters the chemical and physical nature of the extract.

Similar results have been observed when using Oriental or Burley starting tobaccos.

It can be seen that the viscosity of the extract of example 1 is more than twice that obtained by a process similar to that of EP1915064 (i.e. the comparative test). A more viscous extract is easier to handle and retain in a smoking article.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method of making a tobacco extract, the method comprising:

(a) contacting tobacco with an extraction solvent in a first chamber such that tobacco components are extracted from the tobacco into the extraction solvent, wherein the extraction solvent is a supercritical fluid in the first chamber;

(b) passing the extraction solvent containing tobacco components along a line towards a second chamber, wherein a valve is present in the line and the conditions downstream of the valve are such that the extraction solvent is subcritical; and (c) pumping entrapment solvent into a flow downstream of the valve and through the second chamber, wherein the tobacco components are released from the extraction solvent by transfer to subcritical conditions and are dissolved in the entrapment solvent, whereby the tobacco components dissolved in entrapment solvent are collected from the second chamber, and wherein entrapment solvent is pumped into the system at an approximately constant flow rate throughout the process, wherein the tobacco components include tobacco aromas and/or flavors.

2. The method according to claim 1, wherein the extraction solvent comprises carbon dioxide.

3. The method according to claim 2 wherein at (a), the temperature is in the range of about 308-473K and the pressure is in the range of about 8-85 MPa.

4. The method of claim 3, wherein at (a), the temperature is in the range of about 328-350K.

5. The method of claim 3, wherein at (a), the pressure is in the range of about 20-30 MPa.

6. The method according to claim 1, wherein the entrapment solvent comprises an aerosol generating agent.

7. The method according to claim 6, wherein the entrapment solvent comprises a polyol.

8. The method according to claim 7, wherein the entrapment solvent comprises glycerol and/or propylene glycol.

9. The method according to claim 1, wherein the tobacco components include nicotine.

10. The method of claim 1, further comprising a step of providing the entrapment solvent containing dissolved tobacco components in a cartridge.

11. The method of claim 10, wherein the cartridge is configured for use in a smoking article.

12. The method of claim 1, wherein the tobacco extract has a viscosity of greater than 0.32 Pa s.

13. The method of claim 1, wherein the tobacco extract has a viscosity of at least 0.74 Pa s.

* * * * *